US007623092B2

(12) United States Patent
Matsui

(10) Patent No.: US 7,623,092 B2
(45) Date of Patent: Nov. 24, 2009

(54) PLASMA DISPLAY DEVICE AND CONTROL METHOD THEREFOR

(75) Inventor: Tomoya Matsui, Kawasaki (JP)

(73) Assignee: Fujitsu Hitachi Plasma Display Limited, Miyazaki (JP)

( * ) Notice: Subject to any disclaimer, the term of this patent is extended or adjusted under 35 U.S.C. 154(b) by 597 days.

(21) Appl. No.: 11/525,897

(22) Filed: Sep. 25, 2006

(65) Prior Publication Data

US 2007/0139303 A1 Jun. 21, 2007

(30) Foreign Application Priority Data

Sep. 30, 2005 (JP) ..... 2005-287266

(51) Int. Cl.
*G09G 3/28* (2006.01)

(52) U.S. Cl. ..... 345/60; 345/204

(58) Field of Classification Search ..... 345/60, 345/63, 204, 208, 210, 690, 691
See application file for complete search history.

(56) References Cited

U.S. PATENT DOCUMENTS 7,012,579 B2 * 3/2006 Choi ..... 345/60
7,046,216 B2 * 5/2006 Lim et al. ..... 345/37
7,286,102 B2 * 10/2007 Yoon et al. ..... 345/60
7,342,558 B2 * 3/2008 Tachibana et al. ..... 345/63
7,423,616 B2 * 9/2008 Ogawa et al. ..... 345/63
7,468,713 B2 * 12/2008 Ogawa et al. ..... 345/63
7,477,215 B2 * 1/2009 Kim et al. ..... 345/68
7,511,685 B2 * 3/2009 Kim et al. ..... 345/60
7,525,512 B2 * 4/2009 Ikura et al. ..... 345/60
7,532,177 B2 * 5/2009 Kwon et al. ..... 345/60
2005/0225509 A1 * 10/2005 Choi et al. ..... 345/60
2005/0225513 A1 * 10/2005 Jung et al. ..... 345/63

(Continued)

FOREIGN PATENT DOCUMENTS

JP 11-352924 12/1999

(Continued)

OTHER PUBLICATIONS

Chinese Patent Office Action, mailed May 23, 2008 and issued in corresponding Chinese Patent Application No. 2006101593601.

(Continued)

*Primary Examiner*—Richard Hjerpe
*Assistant Examiner*—Tom V Sheng
(74) *Attorney, Agent, or Firm*—Staas & Halsey LLP

(57) ABSTRACT

A plurality of sub-frames is classified into first-type and second-type sub-frames. In each reset period of the first-type sub-frames, a gradient voltage pulse having an reverse polarity to that of a final gradient voltage pulse is applied between first and second electrodes prior to the final gradient voltage pulse, while in each reset period of the second-type sub-frames, the gradient voltage having the reverse polarity to that of the final gradient voltage pulse is not applied between the first and second electrodes. There is a plurality of first-type sub-frames in one frame, and the attained voltage of a gradient voltage pulse of reverse polarity included in at least one first-type sub-frame among the plurality of first-type sub-frames differs from that of the gradient voltage pulse of reverse polarity in other first-type sub-frame.

18 Claims, 5 Drawing Sheets

U.S. PATENT DOCUMENTS

2006/0061521 A1* 3/2006 Kim ..... 345/60

FOREIGN PATENT DOCUMENTS

JP 2000-214823 8/2000
JP 2004-157291 6/2004
KR 10-2004-0009331 1/2004
KR 10-2004-0094147 11/2004

OTHER PUBLICATIONS

Office Action issued in corresponding Korean Patent Application No. 10-2006-0094892, on Aug. 28, 2007.

* cited by examiner

PLASMA DISPLAY DEVICE AND CONTROL METHOD THEREFOR

CROSS-REFERENCE TO RELATED APPLICATIONS

This application is based upon and claims the benefit of priority from the prior Japanese Patent Application No. 2005-287266, filed on Sep. 30, 2005, the entire contents of which are incorporated herein by reference.

BACKGROUND OF THE INVENTION

1. Field of the Invention

The present invention relates to a plasma display device and a control method therefor.

2. Description of the Related Art

The plasma display device is a large-sized flat-type display of which market is expanding as a flat television for home use, and power consumption, display quality and a cost of the same order of CRT are required.

The following patent document 1 describes a drive method of the plasma display panel in which a sawtooth-waveform erasing pulse is applied to a main electrode.

Also, the following patent document 2 describes a drive method of the plasma display panel in which a ramp voltage is applied in an initialization period.

[Patent document 1] Japanese Patent Application Laid-open No. Hei 11-352924.

[Patent document 2] Japanese Patent Application Laid-open No. 2000-214823.

SUMMARY OF THE INVENTION

It is an object of the present invention to provide a plasma display device and a control method therefor, capable of realizing a high contrast and a wide drive margin by enhancing a reset function in a reset period.

According to the present invention, the plasma display device includes a plurality of sub-frames in one frame, each sub-frame having a reset period, an address period and a sustain discharge period, and in the above address period, a discharge for display selection occurs at least between first and second electrodes, and at the end of the reset period, reset is performed by applying a gradient voltage pulse between the first and second electrodes, and the final gradient voltage pulse in the reset period has an identical polarity to that of a voltage applied between the first and second electrodes when the discharge occurs in the address period, and the plurality of sub-frames is classified into first-type and second-type sub-frames, and in the reset period of the first-type sub-frames, a gradient voltage pulse having the reverse polarity of the final gradient voltage pulse is applied between the first and second electrodes, prior to the final gradient voltage pulse, and in the reset period of the second-type sub-frames, the gradient voltage pulse having the reverse polarity of the final gradient voltage pulse is not applied between the first and second electrodes, and a plurality of first-type sub-frames is existent in one frame, and an attained voltage of the gradient voltage pulse of reverse polarity in at least one first-type sub-frame among the plurality of first-type sub-frames is different from that of the gradient voltage pulse of reverse polarity in other first-type sub-frame.

Further, according to the present invention, the method for controlling the plasma display device includes a plurality of sub-frames in one frame, each sub-frame having a reset period, an address period and a sustain discharge period, and in the address period, a discharge for display selection occurs at least between first and second electrodes, and at the end of the reset period, reset is performed by applying a gradient voltage pulse between the first and second electrodes, and the final gradient voltage pulse in the reset period has an identical polarity to that of a voltage applied between the first and second electrodes when the discharge occurs in the address period, and the plurality of sub-frames is classified into first-type and second-type sub-frames, and in the reset period of the first-type sub-frames, a gradient voltage pulse having the reverse polarity of the final gradient voltage pulse is applied between the first and second electrodes, prior to the final gradient voltage pulse, and in the reset period of the second-type sub-frames, the gradient voltage pulse having the reverse polarity of the final gradient voltage pulse is not applied between the first and second electrodes, and a plurality of first-type sub-frames is existent in one frame, and an attained voltage of the gradient voltage pulse of reverse polarity in at least one first-type sub-frame among the plurality of first-type sub-frames is different from that of the gradient voltage pulse of reverse polarity in other first-type sub-frame.

DETAILED DESCRIPTION OF THE PREFERRED EMBODIMENTS

Figure 1:
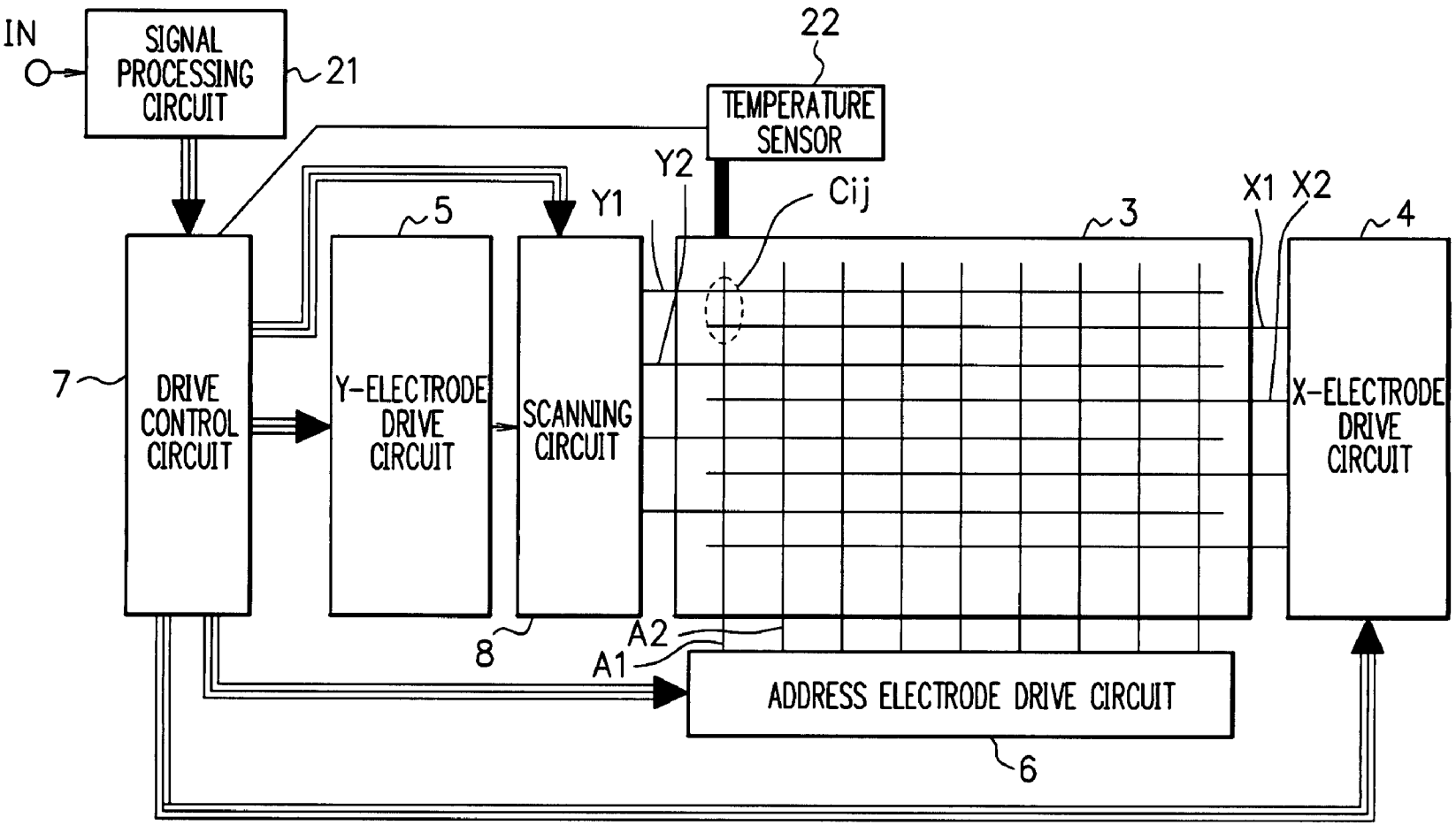
FIG. 1 shows a diagram illustrating an exemplary configuration of a plasma display device according to an embodiment of the present invention.

FIG. 1 shows a diagram illustrating an exemplary configuration of a plasma display device according to an embodiment of the present invention. A signal processing circuit 21 processes a signal input from an input terminal IN, and outputs it to a drive control circuit 7. A temperature sensor 22 detects the temperature of a plasma display panel 3 or a chassis, so as to output it to the drive control circuit 7. The drive control circuit 7 controls an X-electrode drive circuit 4, a Y-electrode drive circuit 5, a scanning circuit 8 and an address electrode drive circuit 6 according to the temperature of the plasma display panel 3 or the chassis. The X-electrode drive circuit 4 supplies a predetermined voltage to a plurality of X-electrodes X1, X2, . . . . Hereinafter, each X-electrode X1, X2, . . . or the generic term thereof is referred to as X-electrode Xi, where i signifies a suffix. The Y-electrode drive circuit 5 supplies a predetermined voltage to a plurality of Y-electrodes Y1, Y2, . . . , via the scanning circuit 8. Hereinafter, each Y-electrode Y1, Y2, . . . or the generic term thereof is referred to as Y-electrode Yi, where i signifies a suffix. The address electrode drive circuit 6 supplies a predetermined voltage to a plurality of address electrodes A1, A2, . . . . Hereinafter, each address electrode A1, A2, . . . or the generic term thereof is referred to as address electrode Aj, where j signifies a suffix.

In the plasma display panel 3, the X-electrode Xi and the Y-electrode Yi form a row extending in parallel in the horizontal direction, while the address electrode Aj forms a column extending in the vertical direction so as to intersect with the X-electrode Xi and the Y-electrode Yi. The Y-electrode Yi and the X-electrode Xi are disposed alternately in the vertical direction. The Y-electrode Yi and the address electrode Aj form a two-dimensional matrix having i rows and j columns. A display cell Cij is formed of a cross point of a Y-electrode Yi and an address electrode Aj and an X-electrode Xi being disposed in an adjacent location correspondingly thereto. The above display cell Cij corresponds to a pixel, by which the plasma display panel 3 can display a two-dimensional image. An HDTV with a full specification has pixels of 1,920 (horizontal direction)×1,080 (vertical direction).

Figure 2:
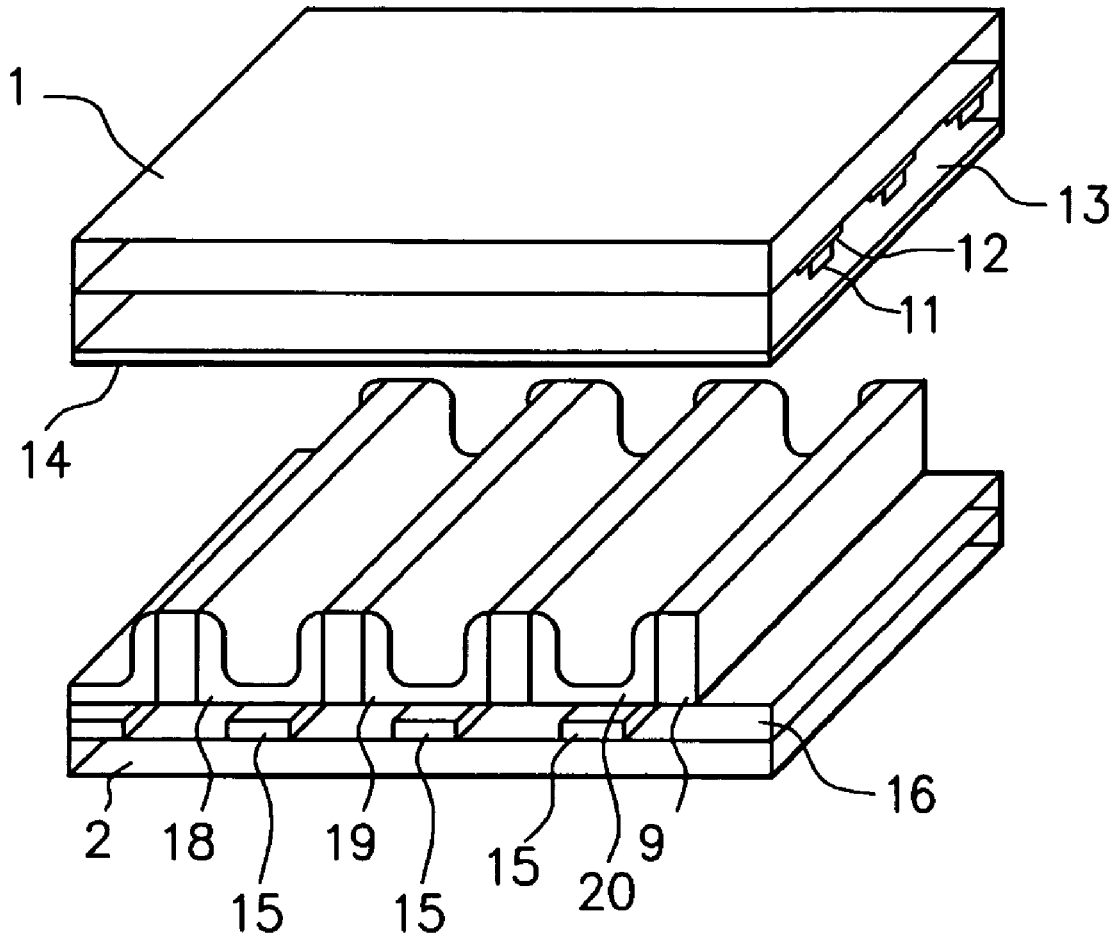
FIG. 2 shows an exploded perspective view illustrating the exemplary structure of the plasma display panel according to the present embodiment.

FIG. 2 shows an exploded perspective view illustrating an exemplary structure of a plasma display panel 3 according to the present embodiment. A bus electrode 11 is formed on a transparent electrode 12. The pair of electrodes 11 and 12 corresponds to the X-electrode Xi or the Y-electrode Yi shown in FIG. 1. The X-electrode Xi and the Y-electrode Yi are formed alternately on a front face glass substrate 1. On the top thereof, a dielectric layer 13 is deposited to cover for the purpose of insulation from a discharge space. Further, an MgO (magnesium oxide) protection layer 14 is deposited on the dielectric layer 13. Meanwhile, corresponding to the address electrode Aj shown in FIG. 1, the address electrode 15 is formed on a back face glass substrate 2 which is disposed to face the front face glass substrate 1. On the top thereof, a dielectric layer 16 is deposited. Further, on the top thereof, red phosphor layer 18, green phosphor layer 19 and blue phosphor layer 20 are deposited. On the internal face of a partition wall (rib) 9, red, blue and green phosphor layers 18-20 are disposed and coated in a stripe shape on a color-by-color basis. Each color is emitted from the phosphor layers 18-20 which are excited by the discharge between the X-electrode Xi and the Y-electrode Yi. In the discharge space between the front face glass substrate 1 and the back face glass substrate 2, a discharge gas such as Ne+Xe Penning gas is sealed.

Figure 3:
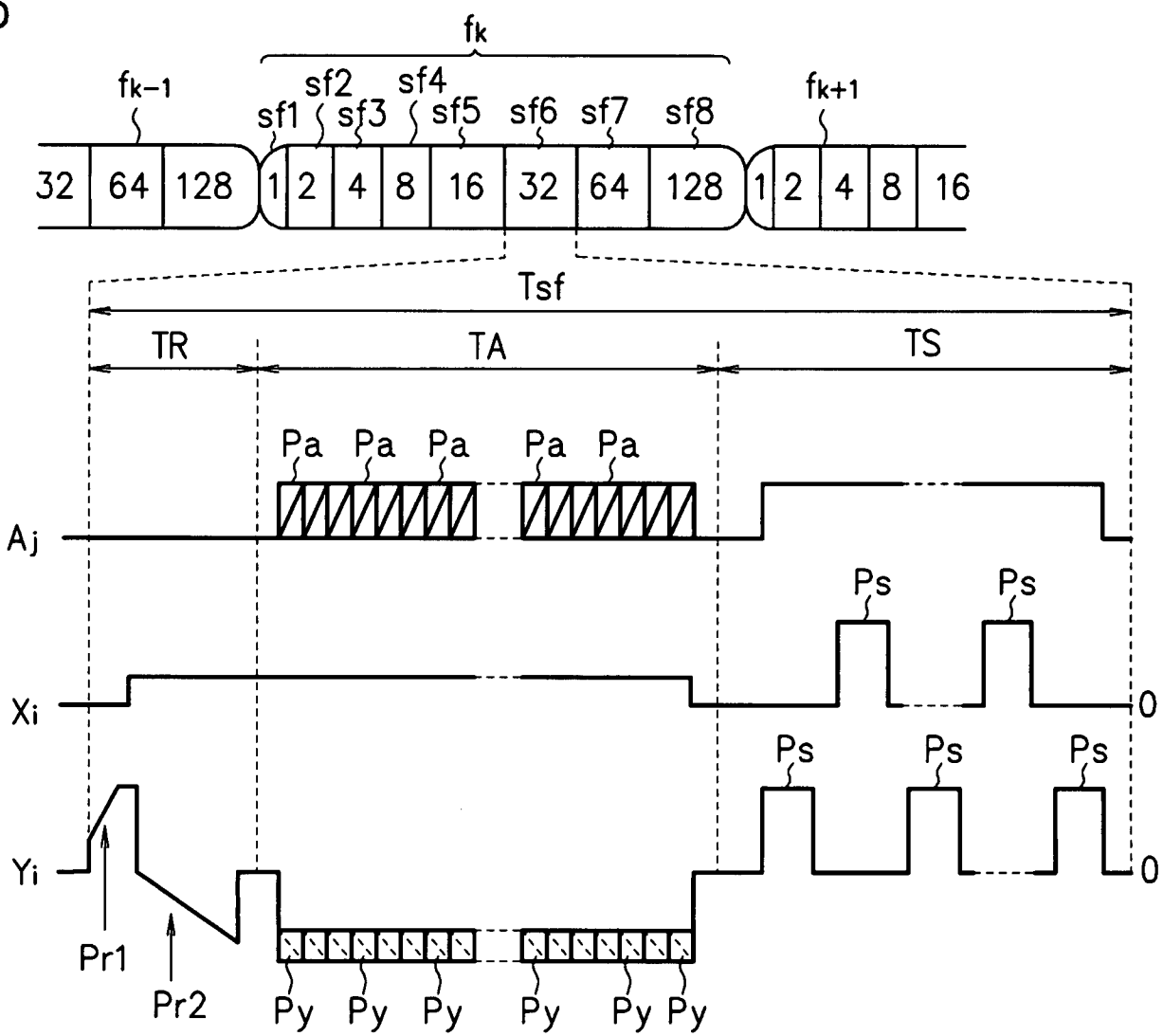
FIG. 3 shows a diagram illustrating an exemplary schematic configuration of one frame of an image.

FIG. 3 shows a diagram illustrating an exemplary schematic configuration of one frame fk of an image. The image is constituted of a plurality of frames fk−1, fk, fk+1, etc. One frame fk is formed of, for example, a first sub-frame sf1, a second substrate sf2, . . . to an eighth sub-frame sf8. Hereinafter, each sub-frame sf1, sf2, . . . or a generic term thereof is referred to as sub-frame sf. Each sub-frame sf includes a weight corresponding to the number of gradation bits.

Each sub-frame sf is constituted of a reset period TR, an address period TA and a sustain (hold) discharge period TS. In the reset period TR, a display cell Cij is initialized. To the Y-electrode Yi, a positive obtuse wave (a waveform having a positive gradient) Pr1 and a negative obtuse wave (a waveform having a negative gradient) Pr2 are applied.

In the address period TA, emission or non-emission of each display cell Cij can be selected by means of a discharge between the address electrode Aj and the Y-electrode Yi, and an accompanying discharge between the X-electrode Xi and the Y-electrode Yi. More specifically, scanning pulses Py are successively applied to the Y-electrodes Y1, Y2, Y3, Y4, . . . . By applying an address pulse Pa to the address electrode Aj corresponding to the above each scanning pulse Py, a discharge occurs between the address electrode Aj and the Y-electrode Yi. With the above discharge, functioning as a pilot burner, a discharge between the X-electrode Xi and the Y-electrode Yi occurs. As a result of the above discharge, wall charges are produced on the X-electrode Xi and the Y-electrode Yi, and thus, emission or non-emission of a desired cell Cij can be selected.

In the sustain period TS, a sustain discharge is performed between the X-electrode Xi and the Y-electrode Yi of the selected display cell Cij, and thereby emission is performed. In each sub-frame sf, the number of times of emission caused by sustain discharge pulses Ps between the X-electrode Xi and the Y-electrode Yi (namely, the length of the sustain period TS) differs. This can fix a gradation value. Each sustain discharge pulse Ps is a pulse having either 0 V or a voltage Vs.

Next, the structure of one frame according to the present embodiment is described more specifically. Each frame fk or the like includes, for example, 10 sub-frames sf1-sf10. A first sub-frame sf1 is a first-type sub-frame shown in FIG. 4, and the attained voltage of a gradient voltage pulse 401 is 259 V. In contrast, a second sub-frame sf2 to a fifth sub-frame sf5 are second-type sub-frames shown in FIG. 5. A sixth sub-frame sf6 to a tenth sub-frame sf10 are the first-type sub-frames shown in FIG. 4, and the attained voltage of the gradient voltage pulse 401 is 166 V.

Figure 4:
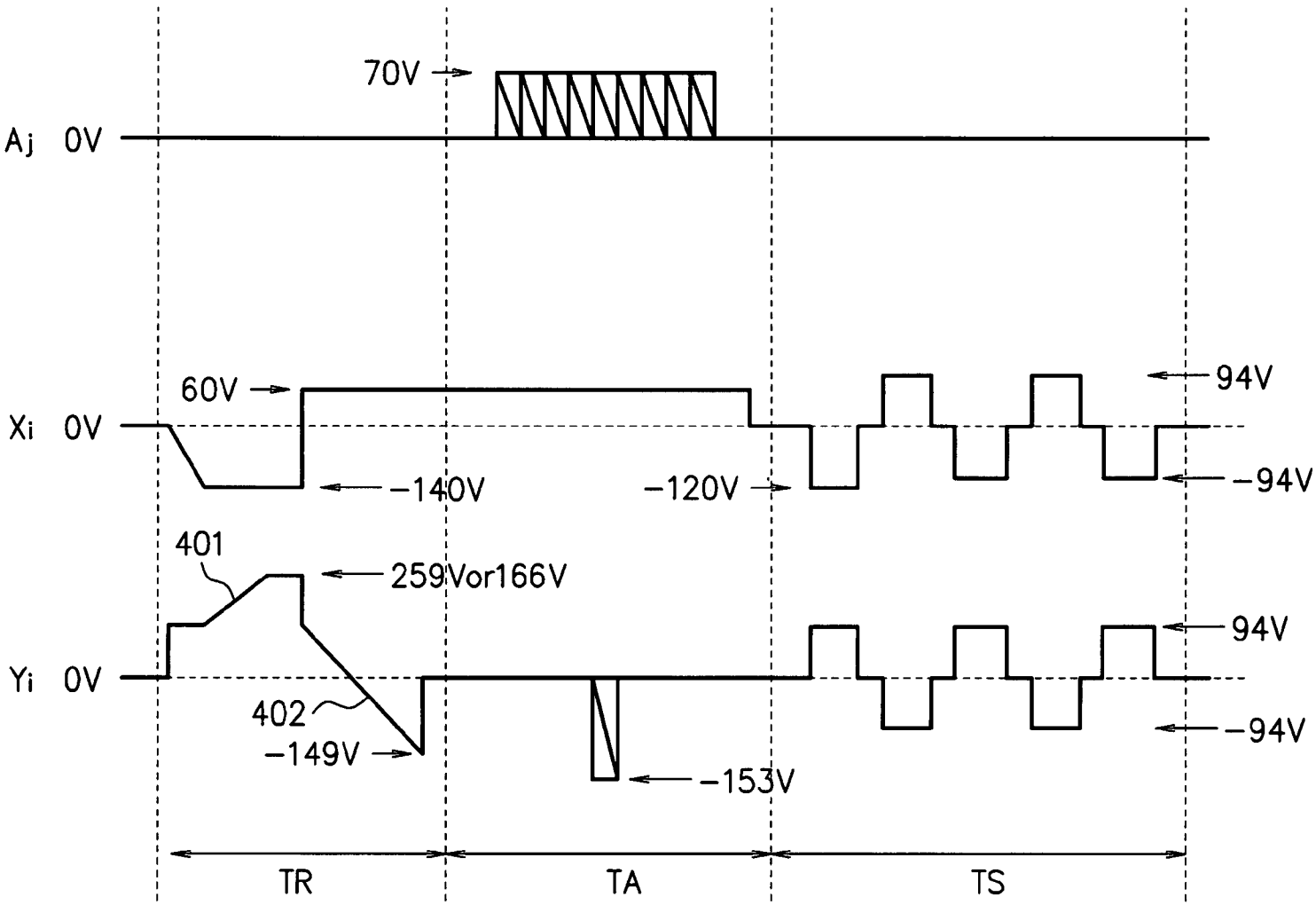
FIG. 4 shows a waveform diagram illustrating an exemplary configuration of a first-type sub-frame.

FIG. 4 shows a waveform diagram illustrating an exemplary configuration of a first-type sub-frame. The first-type sub-frame is constituted of a reset period TR, an address period TA and a sustain discharge period TS.

In the reset period TR, initialization of the display cell Cij is performed. First, a positive gradient voltage pulse 401 having a gradually increasing voltage is applied to the Y-electrode Yi, while −140 V is applied to the X-electrode Xi. In case of the first sub-frame sf1, the attained voltage of the positive gradient voltage pulse 401 is 259 V, while in case of the sixth sub-frame sf6 to the tenth sub-frame sf10, the attained voltage of the positive gradient voltage pulse 401 is 166 V. In the case of the first sub-frame sf1, a positive gradient voltage pulse is applied between the Y-electrode Yi and the X-electrode Xi, of which attained voltage becomes 259+140=399 V. Also, in each case of the sixth sub-frame sf6 to the tenth sub-frame sf10, a positive gradient voltage pulse is applied between the Y-electrode Yi and the X-electrode Xi. The attained voltage becomes 166+140=306 V, which is lower than the attained voltage 399 V of the first sub-frame sf1.

Next, a negative gradient pulse 402 having a gradually decreasing voltage is applied to the Y-electrode Yi, while 60 V is applied to the X-electrode Xi. The attained voltage of the negative gradient voltage pulse is −149 V. At this time, a negative gradient voltage pulse is applied between the Y-electrode Yi and the X-electrode Xi.

In the address period TA, emission or non-emission of each display cell Cij can be selected by the discharge between the address electrode Aj and the Y-electrode Yi and the accompanying discharge between the X-electrode Xi and the Y-electrode Yi. Specifically, negative scanning pulses (−153 V) are successively applied to the Y-electrodes Y1, Y2, Y3, Y4 . . . , and by applying an address pulse (70 V) to the address electrode Aj corresponding to the above each scanning pulse, a discharge occurs between the address electrode Aj and the Y-electrode Yi. With the above discharge functioning as a pilot burner, a discharge between the X-electrode Xi and the Y-electrode Yi occurs. At this time, 60 V is applied to the X-electrode Xi. As a result of the above discharge, wall charges are produced on the X-electrode Xi and the Y-electrode Yi, and thus, emission or non-emission of a desired display cell Cij can be selected.

In the sustain period TS, a sustain discharge is performed between the X-electrode Xi and the Y-electrode Yi of the selected display cell Cij, so as to perform emission. To the X-electrode Xi, first, a sustain discharge pulse of −120 V is applied, and thereafter, sustain discharge pulses of 94 V and sustain discharge pulse of −94 V are applied alternately. To the Y-electrode Yi, sustain discharge pulses of 94 V and sustain discharge pulse of −94 V are applied alternately. A discharge occurs between the X-electrode Xi and the Y-electrode Yi, each time a voltage of 94+94=188 V is applied.

As shown in FIG. 3, in each sub-frame sf, the number of times of emission (the length of the sustain period TS) caused by the sustain discharge pulse between the X-electrode Xi and the Y-electrode Yi differs. This can determine the gradation value.

The scanning circuit 8 shown in FIG. 1 successively applies scanning pulses (−153 V) to the plurality of Y-electrodes Yi in the address period TA. The address electrode drive circuit 6 applies an address pulse (70 V) to the plurality of address electrodes Aj in the address period TA. The X-electrode drive circuit 4 applies a predetermined voltage to the plurality of X-electrodes Xi in both the reset period TR and the address period TA, and also applies sustain discharge pulses for sustaining discharge to the plurality of X-electrodes Xi in the sustain period TS. The Y-electrode drive circuit 5 applies gradient voltage pulses 401, 402 to the plurality of Y-electrodes Yi in the reset period TR, and also applies sustain discharge pulses for sustaining the discharge to the plurality of Y-electrodes Yi in the sustain period TS.

Figure 5:
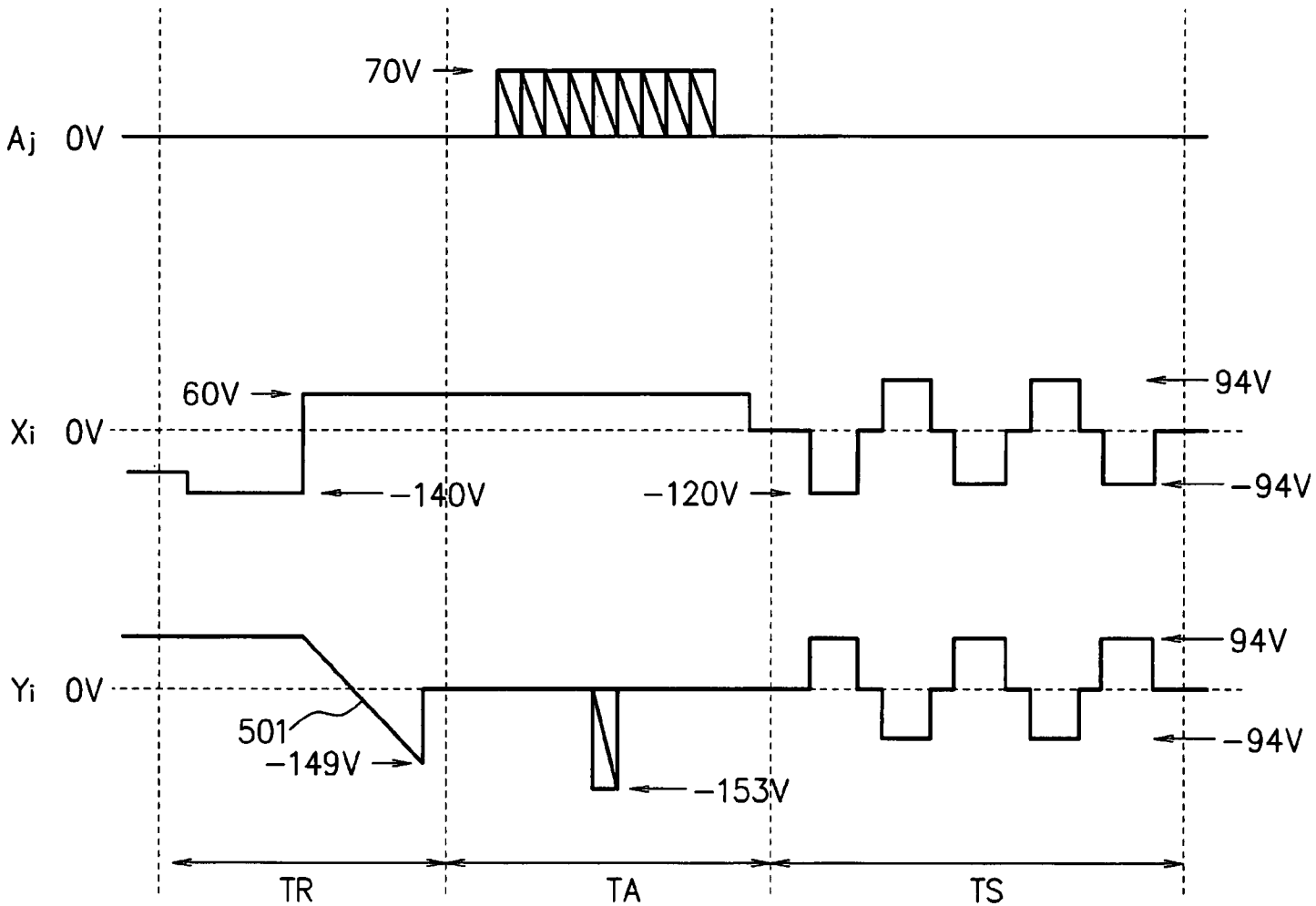
FIG. 5 shows a waveform diagram illustrating an exemplary configuration of a second-type sub-frame.

FIG. 5 shows a waveform diagram illustrating an exemplary configuration of a second-type sub-frame. The second-type sub-frame is constituted of the reset period TR, the address period TA and the sustain discharge period TS. The different points of the second-type sub-frame from the first-type sub-frame will be described in the following. In the reset period TR, a negative gradient voltage pulse 501 is applied to the Y-electrode Yi, instead of applying the positive gradient voltage pulse 401 as shown in FIG. 4. Also, 60 V is applied to the X-electrode Xi. The negative gradient voltage pulse 501 is the same as the negative gradient voltage pulse 402 shown in FIG. 4, of which attained voltage is −149 V. At this time, a negative gradient voltage pulse is applied between the Y-electrode Yi and the X-electrode Xi. The address period TA and the sustain discharge pulse TS of the second-type sub-frame are the same as those of the first-type sub-frame.

As described above, one frame fk, etc. are constituted of the plurality of sub-frames sf1-sf10. Each sub-frame sf1-sf10 includes the reset period TR, the address period TA and the sustain discharge period TS. In the address period TA, a discharge for display selection occurs at least between the X-electrode Xi and the Y-electrode Yi. At the end of the reset period TR, the gradient voltage pulse 402 or 501 is applied to the Y-electrode Yi and the gradient voltage pulse corresponding thereto is applied between the X-electrode Xi and the Y-electrode Yi. Thus, resetting is performed. The gradient voltage pulse applied at the end of the reset period TR has the identical polarity (for example, negative polarity) to the voltage applied between the X-electrode Xi and the Y-electrode Yi when the discharge occurs in the address period TA. Namely, in the reset period TR, a negative gradient voltage pulse 402 or 501 is applied to the Y-electrode Yi, while in the address period TA, a negative scanning pulse (−153 V) is applied to the Y-electrode Yi.

The plurality of sub-frames sf1-sf10 is classified into the first-type sub-frames and the second-type sub-frames. The first sub-frame sf1 is the first-type sub-frame shown in FIG. 4, while the second sub-frame sf2 to the fifth sub-frame sf5 are the second-type sub-frames shown in FIG. 5. Further, the sixth sub-frame sf6 to the tenth sub-frame sf10 are the first-type sub-frames shown in FIG. 4.

In the reset period TR of the first-type sub-frame shown in FIG. 4, a gradient voltage pulse 401 having the reverse polarity to that of the final gradient voltage pulse 402 is applied to the Y-electrode Yi prior to the final gradient voltage pulse 402. At this time, the X-electrode Xi is kept to a constant voltage.

In the reset period TR of the second-type sub-frame shown in FIG. 5, the gradient voltage pulse having the reverse polarity to that of the final gradient voltage pulse 501 is not applied between the X-electrode Xi and the Y-electrode Yi.

There is a plurality of first-type sub-frames existent in one frame. In at least one first-type sub-frame (for example, the sub-frame sf1) among the plurality of first-type sub-frames, the attained voltage (for example, 259 V of the Y-electrode, and 399 V between the Y-electrode Yi and the X-electrode Xi) of the gradient voltage pulse 401 having reverse polarity is different from the attained voltages (for example, 166 V as to the Y-electrode Yi, and 306 V between the Y-electrode Yi and the X-electrode Xi) of the gradient voltage pulses 401 of reverse polarity in other first-type sub-frames (for example, the sub-frames sf6-sf10).

Among the plurality of first-type sub-frames in one frame, the absolute voltage value of the gradient voltage pulse 401 having reverse polarity (for example, 259 V of the Y-electrode Yi, and 399 V between the Y-electrode Yi and the X-electrode Xi) in the top first-type sub-frame (for example, the sub-frame sf1) is greater than the absolute values of the attained voltages (for example, 166 V as to the Y-electrode Yi, and 306 V between the Y-electrode Yi and the X-electrode Xi) of the gradient voltage pulses 401 of reverse polarity in the second or later first-type sub-frame (for example, the sub-frames sf6-sf10).

Among the plurality of first-type sub-frames in one frame, the absolute value of the attained voltage of the gradient voltage pulse 401 having reverse polarity in the top first-type sub-frame (for example, the sub-frame sf1) has the greatest value among the absolute values of the applied voltages between the X-electrode Xi and the Y-electrode Yi in the above one frame.

Normally, the number of the first-type sub-frames having a high attained voltage (259 V) of the positive gradient voltage pulse 401 is set to one. However, a plurality may be accepted. In case of the plurality, although the probability of missing address in the address period TA is decreased, background emission increases.

The second-type sub-frames enable restraint of background emission, producing a higher contrast.

The sub-frames sf6-sf10 are first-type sub-frames having low voltage (166 V) of the attained voltage of the positive gradient voltage pulse 401. The above sub-frames play the role of restoring wall charge when the temperature of the plasma display panel 3 becomes high and the wall charge is attenuated. Accordingly, by detecting the temperature of the plasma display panel 3, as the temperature of the plasma display panel 3 is higher, it is desirable to increase the number of the first-type sub-frames having a low voltage (166 V) of the attained voltage of the positive gradient voltage pulse 401, or to increase the attained voltage of the positive gradient voltage pulse 401 thereof. Also, generally the temperature becomes up and down in the overall plasma display device. Therefore, instead of really detecting the temperature of the plasma display panel 3, it may be possible to detect the temperature of other different places in the device having a similar structure to the plasma display panel, such as the chassis.

Thus, in response to the temperature of the plasma display panel 3 or the chassis detected by the temperature sensor 22, the drive control circuit 7 shown in FIG. 1 performs the following control: The drive control circuit 7 controls to increase the number of the first-type sub-frames [in particular, the first-type sub-frames of a low voltage (166 V) of the attained voltage of the positive gradient voltage pulse 401], as the temperature of the plasma display panel or the chassis becomes higher.

Also, the drive control circuit 7 controls to set to a higher value the absolute value of the attained voltage of the gradient voltage pulse 401 having reverse polarity in at least one first-type sub-frame [in particular, the first-type sub-frames of a low voltage (166 V) of the attained voltage of the positive gradient voltage pulse 401], as the temperature of the plasma display panel or the chassis becomes higher.

As described above, according to the present embodiment, it becomes possible to enhance a reset function in the reset period. As a result, the background emission can be restrained, and the drive margin can be expanded particularly at the time of high temperature. This makes it possible to realize a plasma display device having a high contrast and a wide drive margin.

In the aforementioned embodiments, typical examples for embodying the present invention have merely been described, and it is not to be understood the technical scope of the present invention restrictively. The present invention may be implemented in various forms without deviating from the technical idea or the major features of the present invention.

According to the present invention, it becomes possible to enhance a reset function in the reset period. As a result, the background emission can be restrained, and the drive margin can be expanded particularly at the time of high temperature. This makes it possible to realize a plasma display device having a high contrast and a wide drive margin.

What is claimed is:

1. A plasma display device comprising a plurality of sub-frames in one frame, each sub-frame having a reset period, an address period and a sustain discharge period, wherein, in said address period, a discharge for display selection occurs at least between first and second electrodes, at the end of said reset period, reset is performed by applying a gradient voltage pulse between said first and second electrodes, and the final gradient voltage pulse in said reset period has an identical polarity to that of a voltage applied between said first and second electrodes when the discharge occurs in said address period, wherein said plurality of sub-frames is classified into first-type and second-type sub-frames, in the reset period of said first-type sub-frames, a gradient voltage pulse having the reverse polarity to that of said final gradient voltage pulse is applied between said first and second electrodes, prior to said final gradient voltage pulse, and in the reset period of said second-type sub-frames, the gradient voltage pulse having the reverse polarity to that of said final gradient voltage pulse is not applied between said first and second electrodes, and wherein a plurality of said first-type sub-frames is existent in one frame, and an attained voltage of said gradient voltage pulse of reverse polarity in at least one first-type sub-frame among said plurality of first-type sub-frames is different from that of said gradient voltage pulse of reverse polarity in other first-type sub-frame.

2. The plasma display device according to claim 1, wherein, among said plurality of first-type sub-frames in said one frame, an absolute voltage value of said gradient voltage pulse of reverse polarity in the top first-type sub-frame is greater than the absolute attained voltage value of said gradient voltage pulse of reverse polarity in the second or later first-type sub-frame.

3. The plasma display device according to claim 2, wherein, among said plurality of first-type sub-frames in said one frame, an absolute voltage value of said gradient voltage pulse of reverse polarity in the top first-type sub-frame is the greatest one of the applied voltages between said first and second electrodes in said one frame.

4. The plasma display device according to claim 3, wherein the number of said first-type sub-frames is controlled to be greater, as a plasma display panel temperature or a chassis temperature becomes higher.

5. The plasma display device according to claim 3, wherein the absolute value of attained voltage of said gradient voltage pulse of reverse polarity in at least one first-type sub-frame is controlled to be greater, as a plasma display panel temperature or a chassis temperature becomes higher.

6. The plasma display device according to claim 2, wherein the number of said first-type sub-frames is controlled to be greater, as a plasma display panel temperature or a chassis temperature becomes higher.

7. The plasma display device according to claim 2, wherein the absolute value of attained voltage of said gradient voltage pulse of reverse polarity in at least one first-type sub-frame is controlled to be greater, as a plasma display panel temperature or a chassis temperature becomes higher.

8. The plasma display device according to claim 1, wherein the number of said first-type sub-frames is controlled to be greater, as a plasma display panel temperature or a chassis temperature becomes higher.

9. The plasma display device according to claim 1, wherein the absolute value of attained voltage of said gradient voltage pulse of reverse polarity in at least one first-type sub-frame is controlled to be greater, as a plasma display panel temperature or a chassis temperature becomes higher.

10. A method for controlling a plasma display device comprising a plurality of sub-frames in one frame, each sub-frame having a reset period, an address period and a sustain discharge period, wherein, in said address period, a discharge for display selection occurs at least between first and second electrodes, at the end of said reset period, reset is performed by applying a gradient voltage pulse between said first and second electrodes, and the final gradient voltage pulse in said reset period has an identical polarity to that of a voltage applied between said first and second electrodes when the discharge occurs in said address period, and wherein said plurality of sub-frames is classified into first-type and second-type sub-frames, in the reset period of said first-type sub-frames, a gradient voltage pulse having the reverse polarity to that of said final gradient voltage pulse is applied between said first and second electrodes, prior to said final gradient voltage pulse, in the reset period of said second-type sub-frames, the gradient voltage pulse having the reverse polarity to that of said final gradient voltage pulse is not applied between said first and second electrodes, and wherein a plurality of said first-type sub-frames is existent in one frame, and the attained voltage of said gradient voltage pulse of reverse polarity in at least one first-type sub-frame among said plurality of first-type sub-frames is different from that of said gradient voltage pulse of reverse polarity in other first-type sub-frame.

11. The method for controlling the plasma display device according to claim 10, wherein, among said plurality of first-type sub-frames in said one frame, an absolute voltage value of said gradient voltage pulse of reverse polarity in the top first-type sub-frame is greater than the absolute attained voltage value of said gradient voltage pulse of reverse polarity in the second or later first-type sub-frame.

12. The method for controlling the plasma display device according to claim 11, wherein, among said plurality of first-type sub-frames in said one frame, an absolute voltage value of said gradient voltage pulse of reverse polarity in the top first-type sub-frame is the greatest one of the applied voltages between said first and second electrodes in said one frame.

13. The method for controlling the plasma display device according to claim 12, wherein the number of said first-type sub-frames is controlled to be greater, as a plasma display panel temperature or a chassis temperature becomes higher.

14. The method for controlling the plasma display device according to claim 12, wherein the absolute value of attained voltage of said gradient voltage pulse of reverse polarity in at least one first-type sub-frame is controlled to be greater, as a plasma display panel temperature or a chassis temperature becomes higher.

15. The method for controlling the plasma display device according to claim 11, wherein the number of said first-type sub-frames is controlled to be greater, as a plasma display panel temperature or a chassis temperature becomes higher.

16. The method for controlling the plasma display device according to claim 11, wherein the absolute value of attained voltage of said gradient voltage pulse of reverse polarity in at least one first-type sub-frame is controlled to be greater, as a plasma display panel temperature or a chassis temperature becomes higher.

17. The method for controlling the plasma display device according to claim 10, wherein the number of said first-type sub-frames is controlled to be greater, as a plasma display panel temperature or a chassis temperature becomes higher.

18. The method for controlling the plasma display device according to claim 10, wherein the absolute value of attained voltage of said gradient voltage pulse of reverse polarity in at least one first-type sub-frame is controlled to be greater, as a plasma display panel temperature or a chassis temperature becomes higher.

* * * * *

UNITED STATES PATENT AND TRADEMARK OFFICE

CERTIFICATE OF CORRECTION

PATENT NO. : 7,623,092 B2
APPLICATION NO. : 11/525897
DATED : November 24, 2009
INVENTOR(S) : Tomoya Matsui It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 657 days.

Signed and Sealed this

Twenty-sixth Day of October, 2010

David J. Kappos

David J. Kappos
*Director of the United States Patent and Trademark Office*